US006820323B1

(12) United States Patent
Kino et al.

(10) Patent No.: US 6,820,323 B1
(45) Date of Patent: Nov. 23, 2004

(54) METHOD OF FIRING MAGNETIC CORES

(75) Inventors: Hiroyuki Kino, Shiga-ken (JP); Nobuaki Ito, Shiga-ken (JP); Yoshihiro Nishinaga, Hikone (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/523,350

(22) Filed: Mar. 10, 2000

(30) Foreign Application Priority Data

Mar. 11, 1999 (JP) ..... 11-064260
Mar. 11, 1999 (JP) ..... 11-064261

(51) Int. Cl.[7] ..... H01F 3/08; H01F 7/06

(52) U.S. Cl. ..... 29/608; 29/603.2; 29/604; 29/737; 336/96; 336/229; 336/234; 419/10; 419/19; 419/30; 419/35; 419/42; 419/49

(58) Field of Search ..... 29/603.2, 604, 29/607, 608, 737; 336/96, 229, 234; 419/10, 19, 30, 35, 42, 49

(56) References Cited

U.S. PATENT DOCUMENTS 4,775,598 A * 10/1988 Jaeckel ..... 428/550
4,876,476 A * 10/1989 Kittaka et al. ..... 310/320
4,891,174 A * 1/1990 Seki et al. ..... 264/44
4,988,968 A * 1/1991 Tochio ..... 336/98
5,774,779 A * 6/1998 Tuchinskiy ..... 419/2
5,923,236 A * 7/1999 Rapoport ..... 336/212
5,935,722 A * 8/1999 Moorhead ..... 428/694 A
5,977,854 A * 11/1999 Mihara ..... 336/92
6,005,468 A * 12/1999 Shirahata ..... 336/212
6,013,318 A * 1/2000 Hunt et al. ..... 427/248.1
6,096,966 A * 8/2000 Nishimoto ..... 136/205

FOREIGN PATENT DOCUMENTS

JP 02239159 A * 9/1990 ..... C04B/35/64
JP 03-5377 1/1991
JP 3-145101 6/1991
JP 04-367569 12/1992
JP 04367569 A * 12/1992 ..... C04B/35/64
JP 07-315917 12/1995
JP 08-301-665 11/1996

* cited by examiner

*Primary Examiner*—Peter Vo
*Assistant Examiner*—Paul Kim
(74) *Attorney, Agent, or Firm*—Keating & Bennett, LLP

(57) ABSTRACT

A method of firing magnetic cores includes the steps of attaching a powder to the surface of a plurality of flattened-ring compact bodies made of a magnetic material, arranging the plurality of flattened-ring compact bodies adjacently so that the axes of flattened through-holes of the flattened-ring compact bodies are vertically oriented, and firing the flattened-ring compact bodies while the powder is interposed between the adjacent flattened-ring compact bodies. Alternatively, a method of firing magnetic cores includes the steps of attaching a powder to the surface of a plurality of thin compact bodies made of a magnetic material, vertically arranging the plurality of thin compact bodies adjacently, and firing the thin compact bodies while the powder is interposed between the adjacent thin compact bodies.

22 Claims, 6 Drawing Sheets

METHOD OF FIRING MAGNETIC CORES

BACKGROUND OF THE INVENTION

1. Field of the Invention

The present invention relates to a method of firing magnetic cores, and more particularly, to a method of firing flattened-ring magnetic cores included in noise-suppressing components and other such apparatuses, as well as, a method of firing thin magnetic cores included in noise filters, inductors of transformers, and other such apparatuses.

2. Description of the Related Art

A flattened-ring magnetic core 21 shown in FIG. 5 is known for use as a core in a noise-suppressing component. A signal line such as a flat cable is inserted into a flattened through-hole 22 of the magnetic core 21, and high-frequency noise propagating through the signal line is eliminated. Typically, a cross section of the magnetic core 21 has a length L of a longer side of 10 mm to 100 mm and a length T of a shorter side of 1 to 10 mm, and the through-hole 22 has a length t of a short side of 0.3 mm to 8 mm. The magnetic core 21 is assembled and fired by providing a plurality of flattened-ring compact bodies, which are made of a ferrite material and are provided with the flattened through-holes 22, at an opening surface thereof in a firing container (not shown in the drawing) so that the axes of the through-holes 22 are vertically oriented, and then firing the compact bodies 21 in this arrangement.

A thin magnetic core 210 shown in FIG. 10 is known for use in a noise filter, an inductor of a transformer, and other such components. The core 210 is assembled and fired by arranging a plurality of thin compact bodies 210 made of a ferrite material vertically at one side thereof in a firing container (not shown in the drawing), and firing the compact bodies in this arrangement.

At this stage, each of the flattened-ring compact bodies 21 or the thin compact bodies 210 is spaced apart so that adjacent flattened-ring compact bodies 21 or adjacent thin compact bodies 210 do not stick together during firing. If the adjacent flattened-ring compact bodies 21 or the adjacent thin compact bodies 210 stick together, a chemical reaction may occur in the compact bodies when connected together or contacting each other, or breaks or cracks may occur when the connected compact bodies 21 or 210 are detached from each other by applying mechanical force.

With respect to the conventional method of firing magnetic cores, it is relatively easy to arrange the compact bodies 21 or 210 in a perpendicular orientation in a firing container in which they are placed with sufficient space when the compact bodies 21 or 210 are large, and in particular, when the compact bodies 210 are thick. In such a case, even if slight vibrations and shocks are applied, the flattened-ring compact bodies 21 or the thin compact bodies 210 are not inclined, and the adjacent flattened-ring compact bodies 21 or the adjacent thin compact bodies 210 do not easily stick together during firing.

However, recently, as magnetic cores become thinner and smaller, it is often necessary to fire small flattened-ring compact bodies 21 or small thin compact bodies 210 while they are vertically oriented and spaced apart from each other. In such a case, it is difficult to vertically position separately each of the small flattened-ring compact bodies 21 or the small thin compact bodies 210. When the compact bodies 21 or 210 are small, slight vibrations easily cause the compact bodies 21 or 210 to be tilted, and the adjacent flattened-ring compact bodies 21 or thin compact bodies 210 are brought into contact with each other, and thus a chemical reaction may occur therebetween, or adherence, breaks, or cracks which are not visibly detectable may occur, resulting in an increase in the defect rate, or a decline in reliability of the product.

SUMMARY OF THE INVENTION

In order to overcome the problems described above, preferred embodiments of the present invention provide a method of firing magnetic cores in which firing is performed with a high degree of reliability and mass production is enabled.

According to one preferred embodiment of the present invention, a method of firing magnetic cores includes the steps of attaching a powder to the surface of a plurality of flattened-ring compact bodies made of a magnetic material and having flattened through holes, arranging the plurality of flattened-ring compact bodies adjacently so that the axes of the flattened through-holes of the flattened-ring compact bodies are vertically oriented, and firing the flattened-ring compact bodies while the powder is interposed between the adjacent flattened-ring compact bodies. The powder may preferably include an inorganic material or an organic material having particles with a particle size of about 1,000 $\mu$m or less.

In another preferred embodiment of the present invention, a method of firing magnetic cores includes the steps of attaching a powder to the surface of a plurality of thin compact bodies made of a magnetic material, vertically arranging the plurality of thin compact bodies adjacently, and firing the thin compact bodies while the powder is interposed between the adjacent thin compact bodies. The powder may preferably include an inorganic material or an organic material having particles with a particle size of about 1,000 $\mu$m or less.

The powder attached to the surface of the compact bodies functions as a spacer between the adjacent compact bodies. Therefore, the compact bodies can be arranged in the container by stacking them together, thus facilitating the setting operation. When the compact bodies are fired, the adjacent compact bodies are not brought into direct contact with each other, and thus inconveniences such as reactions in the contact surface therebetween, adherence, and breaks do not occur.

Other features, elements, advantages, steps and characteristics of the present invention will be described in more detail below with reference to the attached drawings.

DETAILED DESCRIPTION OF PREFERRED EMBODIMENTS

A preferred embodiment of a method of firing magnetic cores in the present invention will be described with reference to FIGS. 1 to 4.

Figure 1:
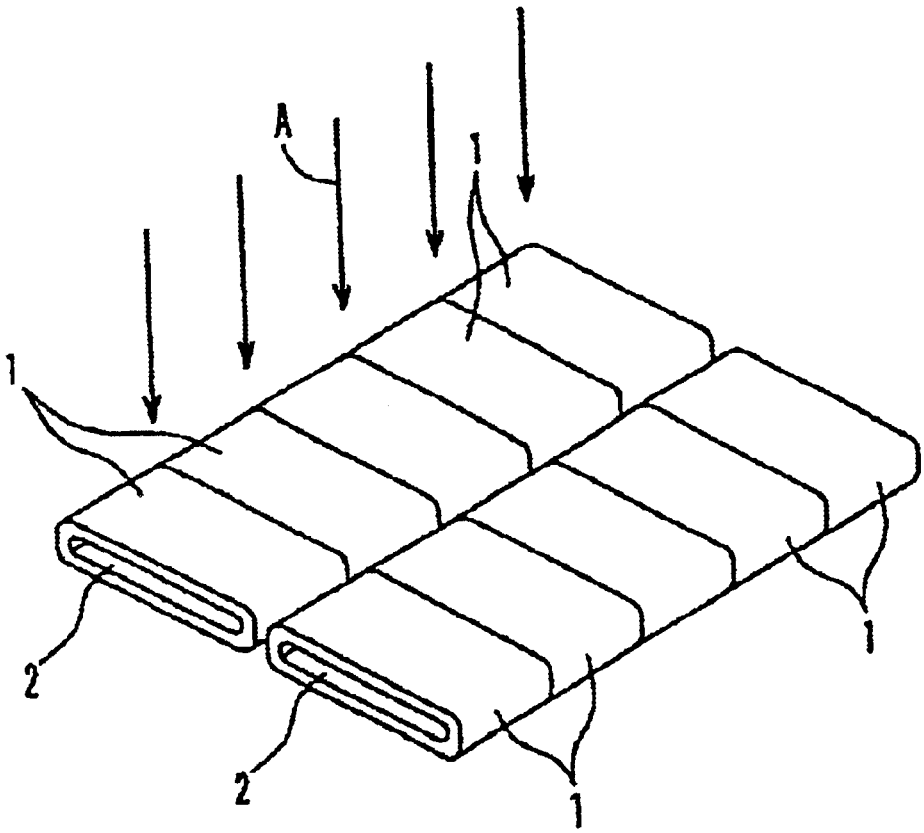
FIG. 1 is a diagram illustrating a step in a method of firing flattened-ring magnetic cores in accordance with preferred embodiments of the present invention.

As shown in FIG. 1, a plurality of flattened-ring compact bodies 1 are prepared. The flattened-ring compact bodies 1 are formed such that a powdered magnetic material such as a ferrite which is mixed with a binder, or other suitable material, is molded into flattened-rings having flattened through-holes 2. Each of the flattened-ring compact bodies 1 is arranged so that the axis of the through-hole 2 is arranged horizontally. Next, as shown by an arrow A in FIG. 1, a powder is sprinkled uniformly over the flattened-ring compact bodies 1. The powder preferably includes particles having a particle size of about 1,000 $\mu$m or less, and is made of an organic material or an inorganic material. An organic material may include a material which is vaporized during firing. Examples of the organic material include polyvinyl alcohol-based synthetic resins, cellulosic synthetic resins, and natural organic materials such as wheat flour and potato starch. The inorganic material may include a material which does not react with the flattened-ring compact bodies 1 during firing. Examples of the inorganic material include alumina and zirconia.

If the particle size of the powder exceeds about 1,000 $\mu$m, the attachment of the powder to the flattened-ring compact bodies 1 is weakened, and when the flattened-ring compact bodies 1 are vertically placed in a subsequent step, the powder easily falls from the surfaces of the flattened-ring compact bodies 1, thus decreasing the setting efficiency of the flattened-ring compact bodies 1. However, by mixing a powder having a particle size of about 1,000 $\mu$m or less with the powder having the particle size of more than about 1,000 $\mu$m, the decrease of the setting efficiency is prevented.

On the other hand, although a powder having a particle size of about 20 $\mu$m or less has a slightly inferior function as a spacer for preventing adherence of the flattened-ring compact bodies 1, it is possible to easily detach the flattened-ring compacts 1, which are stuck together, by lightly applying mechanical force.

Figure 2:
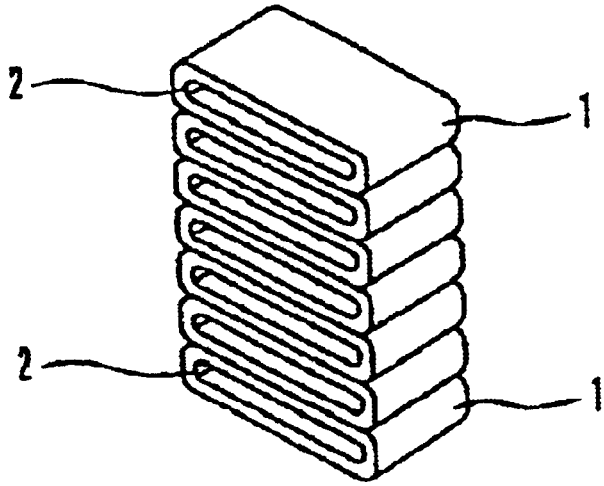
FIG. 2 is a diagram illustrating a step in the method of firing flattened-ring magnetic cores in accordance preferred embodiments of with the present invention.
Figure 3:
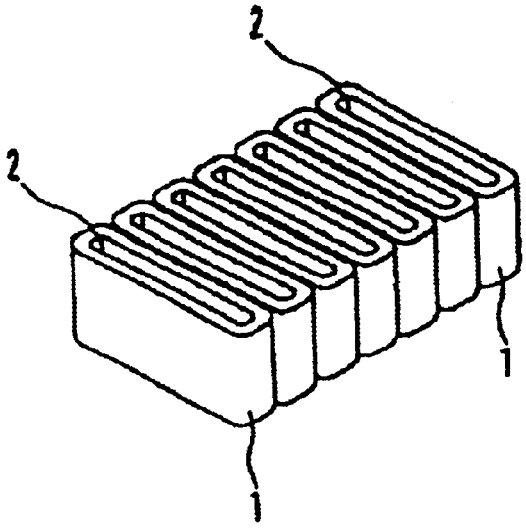
FIG. 3 is a diagram illustrating a step in the method of firing flattened-ring magnetic cores in accordance with preferred embodiments of the present invention.

Next, as shown in FIG. 2, a predetermined number of flattened-ring compact bodies 1 to which the powder is attached are stacked together while aligning the axial direction of the individual compact bodies 1 horizontally. The powder is interposed between the adjacent flattened-ring compact bodies 1 which are stacked together. Then, as shown in FIG. 3, the flattened-ring compact bodies 1 are arranged in a firing container (not shown in the drawing), in which an inorganic powder (such as a high-purity alumina powder or zirconia powder) that does not chemically react with the flattened-ring compact bodies 1 is spread all over, so that the axes of the flattened-ring compacts are vertically oriented while maintaining the stacked state. Additionally, it may not be necessary to spread the inorganic powder in the firing container depending on the shape of the flattened-ring compact bodies 1 or the material of the firing container.

Figure 4:
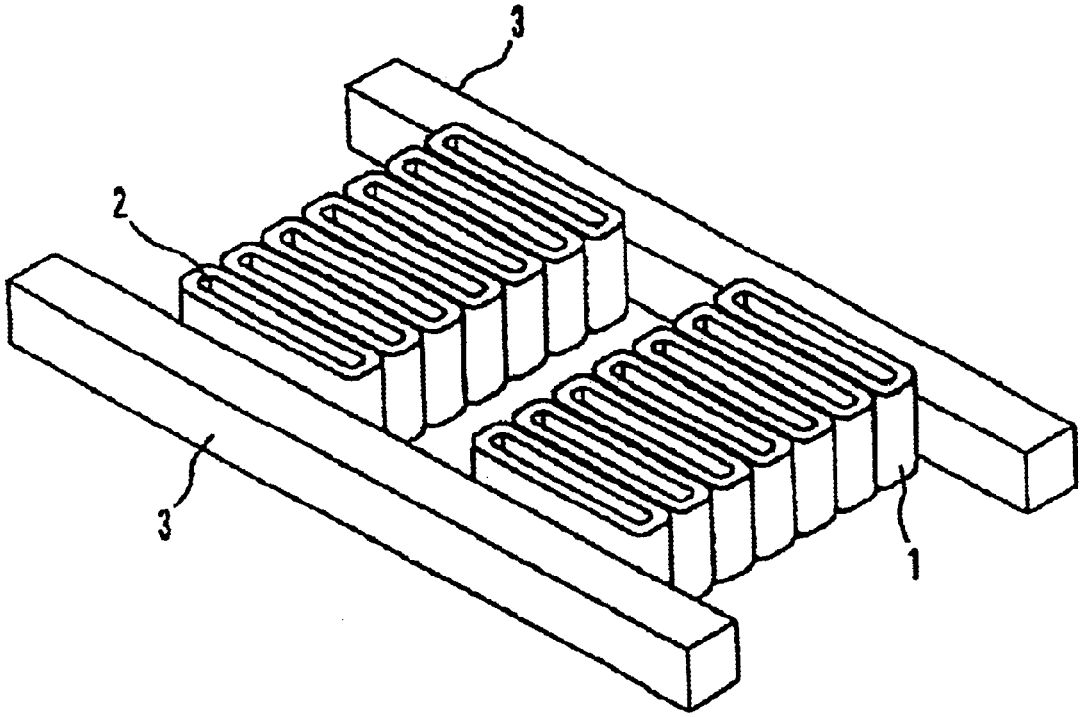
FIG. 4 is a diagram illustrating a step in the method of firing flattened-ring magnetic cores in accordance with preferred embodiments of the present invention.
Figure 5:
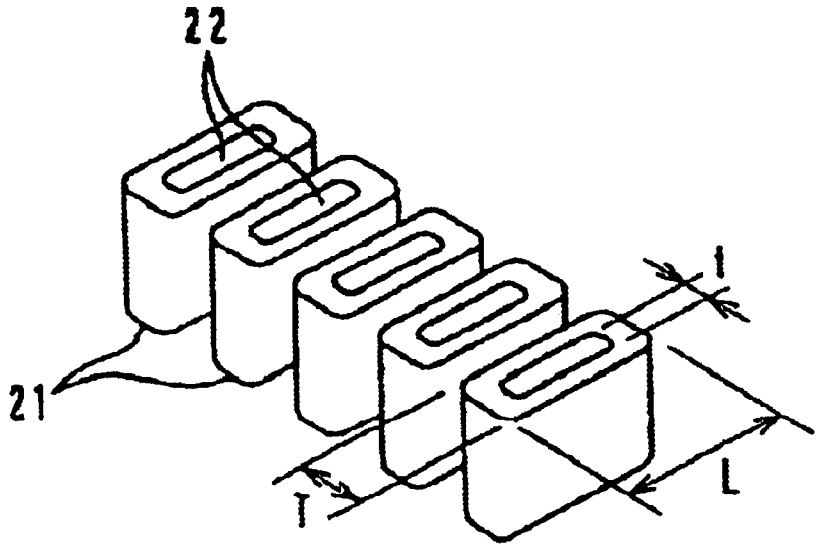
FIG.5 PRIOR ART
FIG. 5 is a diagram illustrating a conventional method of firing flattened-ring magnetic cores.

Next, as shown in FIG. 4, bars 3 made of high-purity alumina, zirconia, or the like are attached to the sides of the stacked flattened-ring compact bodies 1 so as to prevent the vertically placed flattened-ring compact bodies 1 from falling or tilting. The flattened-ring compact bodies 1 which have been arranged as described above are fired in a firing furnace. Accordingly magnetic cores are obtained by firing the flattened-ring compact bodies 1.

The powder attached to the surface of the flattened-ring compact bodies 1 functions as a spacer between the adjacent flattened-ring compact bodies 1. Therefore, the flattened-ring compact bodies 1 can be arranged by stacking together, thus facilitating the arranging operation. When the flattened-ring compact bodies 1 are fired, the adjacent flattened-ring compact bodies 1 are not brought into direct contact with each other, and thus inconveniences such as reactions therebetween, adherence, and breaks do not occur.

Additionally, the present invention is not limited to preferred embodiments described above. For example, although the powder is sprinkled over the flattened-ring compact bodies in preferred embodiments described above, the powder may be fixedly applied to the flattened-ring compact bodies by spraying or other such processes.

Another preferred embodiment of a method of firing magnetic cores in the present invention will be described with reference to FIGS. 6 to 9.

Figure 6:
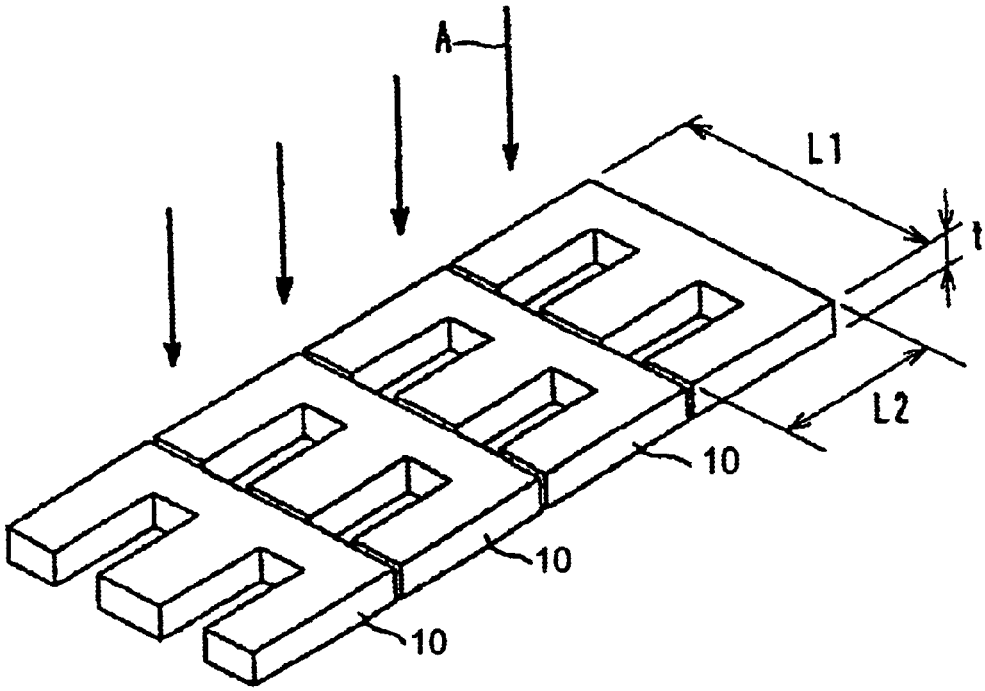
FIG. 6 is a diagram illustrating a step in a method of firing thin magnetic cores in accordance with preferred embodiments of the present invention.

As shown in FIG. 6, a plurality of thin compact bodies 10 are prepared. The thin compact bodies 10 are formed such that a powdered magnetic material such as a ferrite which is mixed with a binder, or other suitable material is molded into a substantially E-shaped configuration. The thin compact bodies 10 have a length L1 of a longer side, a length L2 of a shorter side and a thickness t of the thin green compact 10. The thickness t of the thin green compact 10 is about one third or less of the length L2 of the shorter side. Each of the thin compact bodies 10 is arranged horizontally. Next, as shown by an arrow A in FIG. 6, a powder is sprinkled uniformly over the thin compact bodies 10. The same powder as that in first preferred embodiment is preferably used.

Figure 7:
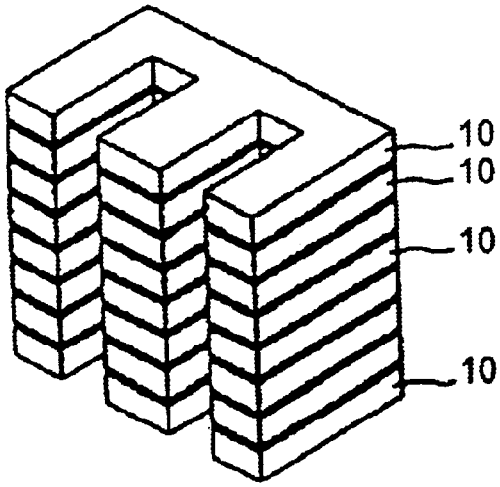
FIG. 7 is a diagram illustrating a step in the method of firing thin magnetic cores in accordance with preferred embodiments of the present invention.
Figure 8:
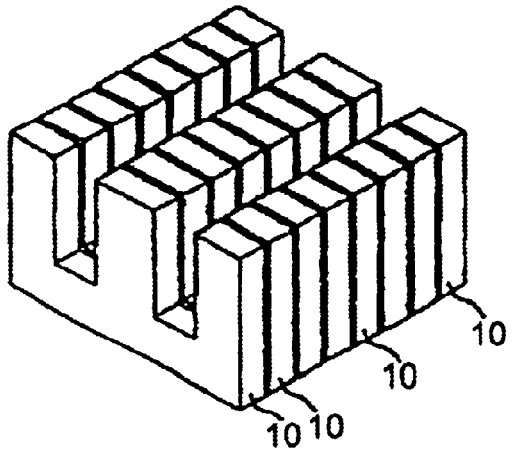
FIG. 8 is a diagram illustrating a step in the method of firing thin magnetic cores in accordance with preferred embodiments of the present invention.

As shown in FIG. 7, a predetermined number of thin compact bodies 10 to which the powder is attached are stacked together by aligning the axial direction of the individual compact bodies 10 horizontally. The powder is interposed between the adjacent thin compact bodies 10 which are stacked together. Then as shown in FIG. 8, the thin compact bodies 10 are arranged in a firing container (not shown in the drawing), in which an inorganic powder (such as a high-purity alumina powder or zirconia powder) that does not chemically react with the thin compact bodies 10 is spread all over, so that the thin compact bodies 10 are vertically oriented while maintaining the stacked state. Additionally, it may not be necessary to spread the inorganic powder in the firing container depending on the shape of the thin compact bodies 10 or the material of the firing container.

Figure 9:
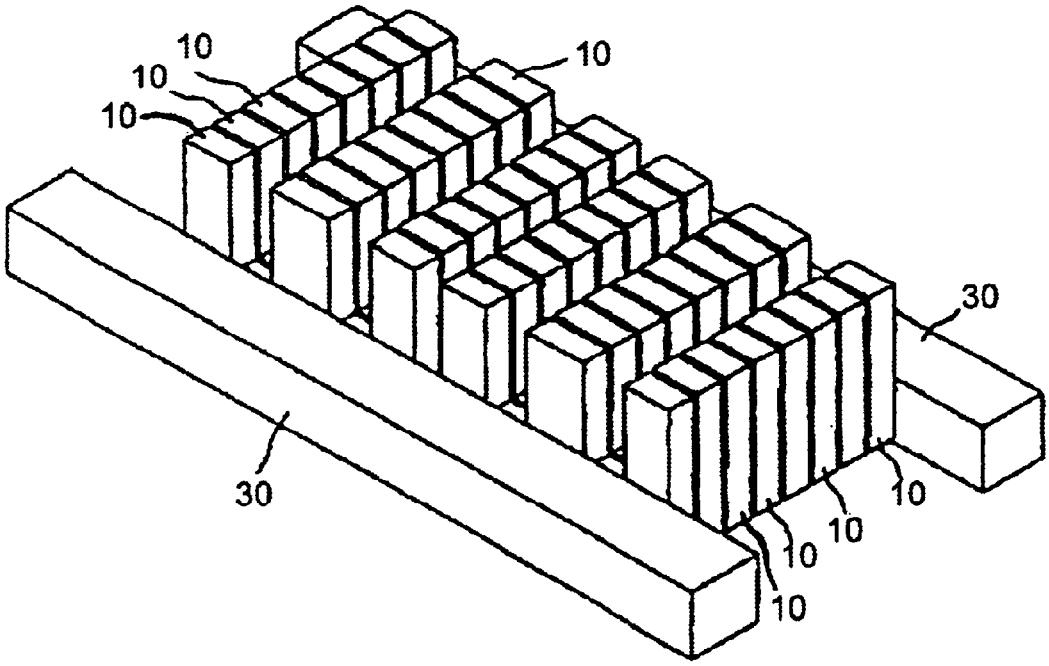
FIG. 9 is a diagram illustrating a step in the method of firing thin magnetic cores in accordance with preferred embodiments of the present invention.
Figure 10:
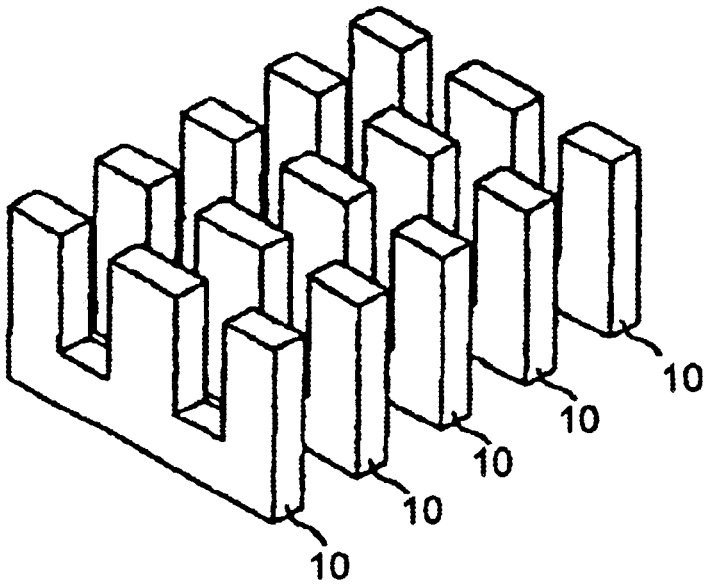
FIG. 10 PRIOR ART
FIG. 10 is a diagram illustrating a conventional method of firing thin magnetic cores.

Next, as shown in FIG. 9, bars 30 made of high-purity alumina, zirconia, or other suitable material are attached to the sides of the stacked thin compact bodies 10 so as to prevent the vertically placed thin compact bodies 10 from falling. The thin compact bodies 10 which have been set as described above are fired in a firing furnace. Magnetic cores are obtained by firing the thin compact bodies 10. Accordingly the preferred embodiment shown in FIG. 6 is manufactured by the method similar to the preferred embodiment shown in FIG. 1, and similar advantages are achieved.

Additionally, the present invention is not limited to the preferred embodiments described above, and various other structures may be adopted within the scope of the present invention. For example, although the powder is sprinkled over the thin compact bodies in the preferred embodiments described above, the powder may be fixedly applied to the thin compact bodies by spraying or other processes. The magnetic core may be U-shaped, I-shaped, ring-shaped, rectangular-shaped with a central dividing line, square-shaped, or have other suitable shapes instead of being E-shaped.

EXAMPLES 1 TO 8

Flattened-ring compact bodies 1 (refer to FIG. 1) with outer dimensions in which the length L of a longer side=22.8 mm, the length T of a shorter side=2.8 mm, and the length in the axial direction=12.0 mm were prepared. The through-holes 2 had a length of a longer side of 18.7 mm and a length t of a shorter side of 0.7 mm. The flattened-ring compact bodies 1 were made of a NiZn ferrite material. Various materials shown in Table 1 below were prepared as powders. After the flattened-ring compact bodies 1 were arranged so that the axes of the through-holes 2 were horizontally oriented, the individual powders shown in Table 1 were sprinkled through a mesh screen uniformly over the flattened-ring compact bodies 1. The flattened-ring compact bodies 1 were stacked together so that the axes were arranged vertically with the sprinkled powders being interposed.

The flattened-ring compact bodies 1 were arranged in 5 rows, with 32 bodies per row, in a firing container in which zirconia powder was spread all over, and bars 3 made of zirconia were attached. Thirty samples of such firing containers in which flattened-ring compact bodies 1 set as described above were prepared (4,800 pieces of flattened-ring compact bodies in total) for each example, and firing was performed in an electric furnace at 1,000 to 1,200° C. Table 1 shows the evaluation results with respect to the adherence rate and the defect rate of the fired magnetic cores (examples 1 to 8). Additionally, Table 1 also includes the evaluation results of magnetic cores fired in a conventional method (comparative example).

TABLE 1

| | Powder | Average Particle Size (μm) | Particle Size Range (μm) | Adherence Rate (%) | Defect Rate (%) |
|---|---|---|---|---|---|
| Example 1 | polyvinyl alcohol-based | 600 | 120 to 1,000 | 0 | 0 |
| Example 2 | polyvinyl alcohol-based | 200 | 60 to 400 | 0 | 0 |
| Example 3 | cellulosic | 40 | 20 to 60 | 15 | 0 |
| Example 4 | wheat flour | 70 | 50 to 80 | 0 | 0 |
| Example 5 | high-purity alumina | 800 | 300 to 1,000 | 0 | 0 |
| Example 6 | high-purity alumina | 200 | 70 to 360 | 0 | 0 |
| Example 7 | high-purity alumina | 80 | 40 to 150 | 0 | 0 |
| Example 8 | high-purity alumina | 40 | 20 to 70 | 14 | 0 |
| Comparative Example | | | | 57 | 2.7 |

As is obvious from Table 1, when firing was performed using the cellulosic powder in example 3 and using the high-purity alumina powder having an average particle size of about 40 μm in example 8, adherence occurred in the magnetic cores at rates of 15% and 14%, respectively. However, in both examples, the magnetic cores were easily detached by lightly applying mechanical forces to the stuck magnetic cores, and satisfactory quality was also obtained, and thus, the defect rate was 0%.

EXAMPLES 9 TO 16

Thin compact bodies 10 (refer to FIG. 6) with outer dimensions in which the length L1 of a longer side=24.0 mm, the length L2 of a shorter side=12.0 mm, and the thickness t=2.8 mm were prepared. The thin compact bodies 10 were made of a NiZn ferrite material. Various materials shown in Table 2 below were prepared as powders. After the thin compact bodies 10 were arranged horizontally, the individual powders shown in Table 2 were sprinkled through a mesh screen uniformly over the thin compact bodies 10. The thin compact bodies 10 were stacked together with the sprinkled powders being interposed so as to be oriented vertically.

In accordance with the steps shown in FIGS. 7 to 9, the thin compact bodies 10 were arranged in 5 rows, with 32 pieces bodies row, in a firing container in which zirconia powder was spread all over, and bars 30 made of zirconia were attached. Thirty samples of such firing containers in which thin compact bodies 10 were set as described above were prepared (4,800 pieces of thin compact bodies 10 in total) for each example, and firing was performed in an electric furnace at 1,000 to 1,200° C. Table 2 shows the evaluation results with respect to the adherence rate and the defect rate of the fired magnetic cores (examples 9 to 16). Additionally, Table 2 also includes the evaluation results of magnetic cores fired in a conventional method (comparative example).

TABLE 2

| | Powder | Average Particle Size (μm) | Particle Size Range (μm) | Adherence Rate (%) | Defect Rate (%) |
|---|---|---|---|---|---|
| Example 9 | polyvinyl alcohol-based | 600 | 120 to 1,000 | 0 | 0 |
| Example 10 | polyvinyl alcohol-based | 200 | 60 to 400 | 0 | 0 |
| Example 11 | cellulosic | 40 | 20 to 60 | 12 | 0 |
| Example 12 | wheat flour | 70 | 50 to 80 | 0 | 0 |
| Example 13 | high-purity alumina | 800 | 300 to 1,000 | 0 | 0 |
| Example 14 | high-purity alumina | 200 | 70 to 360 | 0 | 0 |
| Example 15 | high-purity alumina | 80 | 40 to 150 | 0 | 0 |
| Example 16 | high-purity alumina | 40 | 20 to 70 | 13 | 0 |
| Comparative Example | | | | 45 | 2.2 |

As is seen in Table 2, when firing was performed using the cellulosic powder in example 11 and using the high-purity alumina powder having an average particle size of about 40 μm in example 16, adherence occurred in the magnetic cores at rates of 12% and 13%, respectively. However, in both examples, magnetic cores were easily detached by lightly applying mechanical shocks to the stuck magnetic cores, and satisfactory quality was also obtained, and thus, the defect rate was 0%.

As described above, in accordance with preferred embodiments of the present invention, the powder attached to the surface of magnetic compact bodies shown in the examples functions as a spacer between the adjacent compact bodies. Therefore, the compact bodies can be arranged by stacking together, thus facilitating the arranging operation. When the compact bodies are fired, the adjacent compact bodies are not brought into direct contact with each other, and thus inconveniences such as reactions therebetween, adherence, and breaks are reliably prevented.

Accordingly, it is possible to efficiently fire magnetic cores with a high degree of reliability, and the defect rate is significantly reduced.

While the invention has been particularly shown and described with reference to preferred embodiments thereof, it will be understood by those skilled in the art that the foregoing and other changes in form and details may be made therein without departing from the spirit of the invention.

What is claimed is:

1. A method of firing magnetic cores comprising the steps of:

providing a plurality of flattened-ring compact bodies made of a magnetic material and having flattened through holes;

arranging each of the plurality of flattened-ring compact bodies so that axes of the through holes are arranged horizontally;

attaching a powder made of an organic material to an outer surface of the plurality of flattened-ring compact bodies;

attaching the plurality of flattened-ring compact bodies to one another so that the axes of the flattened through-holes are vertically arranged;

firing the plurality of flattened-ring compact bodies while the powder is interposed between the adjacent flattened-ring compact bodies such that said powder is vaporized during the firing step; and separating said plurality of flattened-ring compact bodies from each other; wherein in the step of attaching the plurality of flattened-ring compact bodies to one another, a bar is attached only to each of a pair of sides of the plurality of flattened-ring compact bodies.

2. The method according to claim 1, wherein the step of arranging includes arranging the plurality of flattened-ring compact bodies in a plurality of rows that are adjacent to each other.

3. The method according to claim 1, wherein the powder comprises the organic material including particles having a particle size of not more than about 1,000 $\mu$m.

4. The method according to claim 1, wherein the powder comprises the organic material including particles having a particle size of about 20 $\mu$m.

5. The method according to claim 1, wherein at least one joint between adjacent flattened-ring compact bodies is exposed after the bars are attached to the thin compact bodies.

6. A method of firing magnetic cores comprising the steps of:

providing a plurality of thin compact bodies made of a magnetic material and having flattened through-holes;

arranging each of the thin compact bodies horizontally;

attaching a powder made of an organic powder to an outer surface of the plurality of thin compact bodies;

vertically stacking and attaching the plurality of thin compact bodies to one another;

firing the plurality of thin compact bodies while the powder is interposed between the adjacent thin compact bodies such that said powder is vaporized during the firing step; and separating said plurality of thin compact bodies from each other; wherein before the step of attaching powder, the plurality of thin compact bodies are arranged so that axes of the flattened-through holes are horizontally arranged; and after the plurality of thin compact bodies are stacked on each other in a vertical stacking direction, the plurality of thin compact bodies are arranged so that the axes of the flattened through-holes are vertically arranged while maintaining the stacked state and a bar is attached only to each of a pair of sides of the stacked thin compact bodies.

7. The method according to claim 6, wherein the step of arranging includes arranging the plurality of thin compact bodies in a plurality of rows that are adjacent to each other.

8. The method according to claim 6, wherein the plurality of thin compact bodies have one of a ring shape, an E-shape, a U-shape, an I-shape, a rectangular shape including a central dividing member, and a square shape.

9. The method according to claim 6, wherein the powder comprises an organic material including particles having a particle size of not more than about 1,000 $\mu$m.

10. The method according to claim 6, wherein the powder comprises an organic material including particles having a particle size of about 20 $\mu$m.

11. The method according to claim 6, wherein at least one joint between adjacent thin compact bodies is exposed after the bars are attached to the thin compact bodies.

12. A method of firing magnetic cores comprising the steps of:

providing a plurality of flattened-ring compact bodies made of a magnetic material and having flattened through holes;

arranging each of the plurality of flattened-ring compact bodies so that axes of the through holes are arranged horizontally;

attaching a powder made of an organic material to an outer surface of the plurality of flattened-ring compact bodies;

attaching the plurality of flattened-ring compact bodies to one another so that the axes of the flattened through-holes are vertically arranged;

firing the plurality of flattened-ring compact bodies while the powder is interposed between the adjacent flattened-ring compact bodies such that said powder is vaporized during the firing step; and separating said plurality of flattened-ring compact bodies from each other; wherein in the step of attaching the plurality of flattened-ring compact bodies to one another, a bar is attached to each of a pair of sides of the plurality of flattened-ring compact bodies such that joints between adjacent thin compact bodies are not covered by the bar.

13. The method according to claim 12, wherein the step of arranging includes arranging the plurality of flattened-ring compact bodies in a plurality of rows that are adjacent to each other.

14. The method according to claim 12, wherein the powder comprises the organic material including particles having a particle size of not more than about 1,000 $\mu$m.

15. The method according to claim 12, wherein the powder comprises the organic material including particles having a particle size of about 20 $\mu$m.

16. The method according to claim 12, wherein at least one joint between adjacent thin compact bodies is exposed after the bars are attached to the flattened-ring compact bodies.

17. A method of firing magnetic cores comprising the steps of:

providing a plurality of thin compact bodies made of a magnetic material and having flattened-through holes;

arranging each of the thin compact bodies horizontally;

attaching a powder made of an organic powder to an outer surface of the plurality of thin compact bodies;

vertically attaching the plurality of thin compact bodies to one another;

firing the plurality of thin compact bodies while the powder is interposed between the adjacent thin compact bodies such that said powder is vaporized during the firing step; and separating said plurality of thin compact bodies from each other; wherein before the step of attaching powder, the plurality of thin compact bodies are arranged so that axes of the flattened-through holes are horizontally arranged; and after the plurality of thin compact bodies are stacked on each other in a vertical stacking direction, the plurality of thin compact bodies are arranged so that the axes of the flattened through-holes are vertically arranged while maintaining the stacked state and a bar is attached to each of a pair of sides of the stacked thin compact bodies such that joints between adjacent thin compact bodies are not covered by the bar.

18. The method according to claim 17, wherein the step of arranging includes arranging the plurality of thin compact bodies in a plurality of rows that are adjacent to each other.

19. The method according to claim 17, wherein the plurality of thin compact bodies have one of a ring shape, an E-shape, a U-shape, an I-shape, a rectangular shape including a central dividing member, and a square shape.

20. The method according to claim 17, wherein the powder comprises an organic material including particles having a particle size of not more than about 1,000 $\mu$m.

21. The method according to claim 17, wherein the powder comprises an organic material including particles having a particle size of about 20 $\mu$m.

22. The method according to claim 17, wherein at least one joint between adjacent thin compact bodies is exposed after the bars are attached to the thin compact bodies.

* * * * *